US007619364B2

(12) United States Patent
Yasuda

(10) Patent No.: US 7,619,364 B2
(45) Date of Patent: Nov. 17, 2009

(54) UV CONTINUOUS SPECTRUM LAMP AND ITS LIGHTING DEVICE

(75) Inventor: Makoto Yasuda, Nagano (JP)

(73) Assignee: ORC Manufacturing Co., Ltd., Tokyo (JP)

( * ) Notice: Subject to any disclaimer, the term of this patent is extended or adjusted under 35 U.S.C. 154(b) by 195 days.

(21) Appl. No.: 11/749,744

(22) Filed: May 16, 2007

(65) Prior Publication Data

US 2007/0285015 A1 Dec. 13, 2007

(30) Foreign Application Priority Data

Jun. 13, 2006 (JP) ..... 2006-162986

(51) Int. Cl.
*H01J 13/46* (2006.01)

(52) U.S. Cl. ..... 315/56; 315/51; 315/334; 315/358; 313/574; 313/631; 313/634

(58) Field of Classification Search ..... 315/49–58, 315/39, 326, 334, 358; 313/574, 623, 631–634, 313/637

See application file for complete search history.

(56) References Cited

U.S. PATENT DOCUMENTS

| | | | | |
|---|---|---|---|---|
| 4,438,373 | A * | 3/1984 | Watanabe et al. | 315/334 |
| 5,610,477 | A * | 3/1997 | Ivanov et al. | 313/573 |
| 5,801,495 | A | 9/1998 | Smolka et al. | |
| 6,400,087 | B2 * | 6/2002 | van den Nieuwenhuizen et al. | 315/73 |
| 6,628,082 | B2 * | 9/2003 | Matsumoto et al. | 315/58 |
| 6,858,988 | B1 * | 2/2005 | Laroussi | 315/111.21 |
| 7,002,299 | B2 * | 2/2006 | Kawaguchi et al. | 313/637 |
| 7,402,954 | B2 * | 7/2008 | Van Den Nieuwenhuizen et al. | 313/625 |
| 2007/0132384 | A1 * | 6/2007 | Nemeth et al. | 313/581 |
| 2008/0203912 | A1 * | 8/2008 | Jinno et al. | 313/581 |

FOREIGN PATENT DOCUMENTS

| | | |
|---|---|---|
| JP | 1989-137554 A | 5/1989 |
| JP | 2001-015073 A | 1/2001 |

* cited by examiner

*Primary Examiner*—David Hung Vu
*Assistant Examiner*—Tung X Le
(74) *Attorney, Agent, or Firm*—patenttm.us

(57) ABSTRACT

To increase radiation intensity of deuterium lamp with continuous spectrum in UV region including vacuum UV in order to enable the lamp to illuminate wide area in high intensity. A pair of electrodes 7 and 8 is covered with dielectrics, placed outside of a UV transparent tubular discharge vessel 1 and plunged into the discharge vessel 1. There is a shield box 2 with a separator 3 between the electrodes 7 and 8 in the discharge vessel 1. Deuterium gas, hydrogen gas, mixture gas with deuterium, or mixture gas with hydrogen is enclosed in the discharge vessel 1 as discharge gas. A slit 4 is formed on the separator 3 along the axis of the discharge vessel 1 in order to squeeze the discharge path arising between the electrodes 7 and 8. The slit 4 makes radiant points continuous and then the lamp length would not be limited. When sine wave in high voltage is applied between the electrodes 7 and 8, dielectric-barrier discharge is caused. Continuous spectrum UV light can be obtained to illuminate the wide area in high radiation intensity.

7 Claims, 4 Drawing Sheets

(a)

(b)

(a)

(b)

(c)

(a)

(b)

UV CONTINUOUS SPECTRUM LAMP AND ITS LIGHTING DEVICE

FIELD OF THE INVENTION

This invention relates to a UV continuous spectrum lamp, especially to an industrial lamp to irradiate continuous spectrum UV light from hydrogen or deuterium gas discharge.

BACKGROUND OF THE INVENTION

In recent years, UV light is often used for cleaning of glass substrates and for various photochemical reactions. Low-pressure mercury lamp and excimer lamps are often used as UV light source. These lamps have strong spectrum near specific wavelength. UV light of the specific wavelength causes various chemical reactions to dissolve and reform the irradiated materials. Low-pressure mercury lamps emit fixed wavelengths at 185 nm and 254 nm. Excimer lamps emit several different wavelengths but cannot emit arbitrary wavelength. Also, it cannot emit in arbitrary wavelength region and wavelength width. And also, it cannot be applied to the field of irradiation with wide-range wavelength.

A deuterium lamp is well known as a lamp to have continuous spectrum from vacuum UV to UV range. Especially, it is used widely for scientific instruments. There are some examples as disclosed in the non-patent document 1 and the patent document 1. Their structure is as follows. A metal shield box with a pinhole is furnished in a discharge vessel with a window to transmit UV light. The shield box is an entirely isolated space except through the pinhole. An anode is disposed in the shield box and a cathode is disposed outside of the shield box. Discharge arises between the anode and the cathode through the pinhole at lighting time and the positive column of discharge is squeezed by the pinhole. Intense continuous spectrum UV light is emitted from the constricted portion of discharge.

The lamp as disclosed in the patent document 1 is a long-life deuterium lamp with improved characteristics of heat radiating from anode. An anode and a cathode are furnished in a glass discharge envelope filled with gas. Electrical leads are connected to the anode and the cathode respectively hermetically passing through the discharge envelope. And also, the lamp has a window shield electrode, a cathode shield electrode, a focusing electrode and a ceramic support. The anode is mounted on the backside of the ceramic support. The heat radiation from the anode to backward is improved. The patent document 2 discloses an industrial deuterium lamp with plural radiating points of about 1 mm in diameter in the tubular lamp.

[Patent document 1] JP2001-015073A

[Patent document 2] JPH01-137554A

[Non-patent document 1] MURAYAMA Seiichi: "The Characteristics of Light Source and its Usage," Measuring Method Series 9 of The Spectroscopical Society of Japan, pp. 23-30, Japan Scientific Societies Press, 1985.

DISCLOSURE OF THE INVENTION

Figure 1:
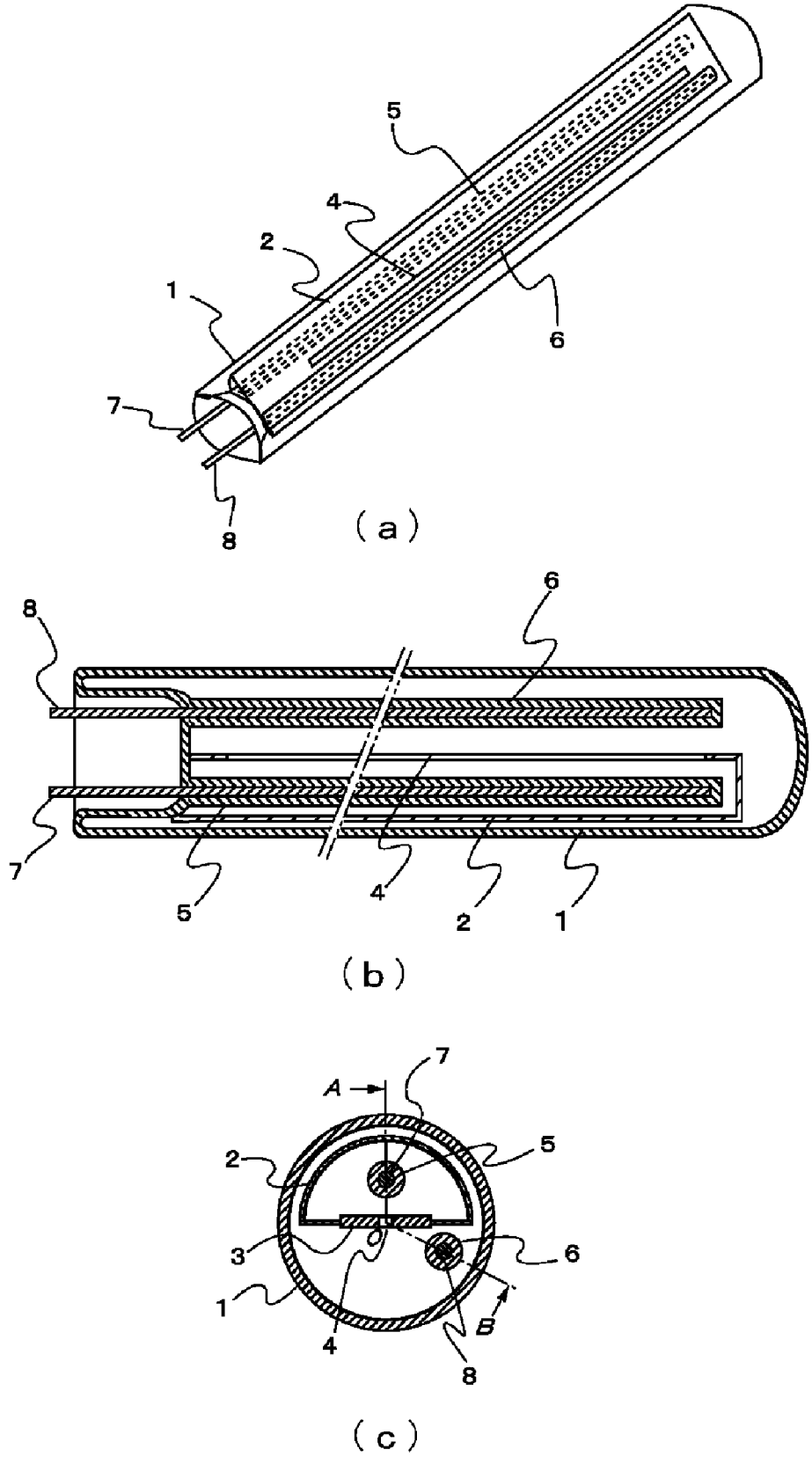
FIG. 1 It shows conceptual drawings of UV continuous spectrum lamp in the first embodiment of this invention.

Problems To Be Solved By The Invention

However, there are following problems in the conventional deuterium lamp. The radiating point of continuous spectrum UV light is restricted in the narrow pinhole region about 1 mm in diameter. Therefore, intensity of UV light is insufficient for illuminant sources used in various photochemical reactions. Even the lamp with plural radiating points as disclosed in the patent document 2 cannot provide so strong illumination intensity as the radiating points are arranged in discrete positions. The structure of such lamp is complicated and the lighting sequence is also complex. So far as pinholes are utilized, it is limited to raise the radiation intensity.

The object of this invention is, solving the above-mentioned problems, to increase the illumination intensity of continuous spectrum UV ray emission of a deuterium lamp to enable the lamp to irradiate wide area with strong illumination.

Means To Solve The Problem

In order to solve the above-mentioned problem, a UV continuous spectrum lamp of this invention is constituted as follows. A UV continuous spectrum lamp comprises a UV transparent discharge vessel, an electrode pair to apply voltage to cause discharge, and a separator with a slit to squeeze discharge path between electrodes, wherein deuterium gas, hydrogen gas, mixture gas with deuterium or mixture gas with hydrogen is enclosed as discharge gas in the discharge vessel. The discharge vessel is tubular and the slit is elongated along the axis of the discharge vessel. Plural of the slits are disposed in series in the direction of the longer edge of the slits or disposed in parallel in the direction perpendicular to the longer edge of the slits or disposed as a lattice in both directions along the longer edge of the slits and perpendicular to it. At least one electrode in the electrode pair is covered with dielectric to be isolated from discharge space. One electrode in the electrode pair is covered with dielectric to be isolated from discharge space and the other electrode in the electrode pair is an electrode of filament in discharge space coated with thermionic emission material.

A lighting device to light a UV continuous spectrum lamp in whose electrode pair at least one electrode is in discharge space is constituted as follows. The lighting device comprises a means to generate pulse voltage to apply to the electrode pair so as to cause discharge to reach abnormal glow discharge state and to terminate discharge before turning to arc discharge. It comprises a means to generate lighting voltage from 1 kHz to 500 kHz in frequency to apply to the electrode pair. Or, it comprises a means to generate lighting voltage from 500 kHz to 100 MHz in frequency to apply to the electrode pair for high frequency discharge.

Advantages Of The Invention

As constituted above, radiating points become continuous and the length of the points is not limited so that the lamp can provide continuous spectrum UV light to illuminate in wide area with strong irradiance.

The Most Preferable Embodiment Of The Invention

Hereinafter, referring to FIGS. 1 to 4, the most preferable embodiments of this invention are explained in detail.

Embodiment 1

The first embodiment of this invention is a UV continuous spectrum lamp to irradiate continuous spectrum UV light by dielectric barrier discharge. Two electrodes are each covered with dielectric to be separated from discharge space. Separator plate with slits to squeeze the discharge path is furnished between the electrodes. Deuterium gas is enclosed in the discharge vessel. FIG. 1(*a*) is a perspective view of the UV continuous spectrum lamp in the first embodiment of this invention. FIG. 1(*b*) is a drawing of a section along the tube axis shown in FIG. 1(*a*) as cut by AOB line shown in FIG. 1(*c*). FIG. 1(*c*) is a drawing of a section perpendicular to the lamp axis. In FIG. 1, a discharge vessel 1 is a synthetic silica cylindrical envelope. It must not be cylindrical but it may be formed something like a cylinder. A shield box 2 is a box of thin nickel plate and a means to isolate one electrode from the other. The side of the shield box 2 near the center of the discharge vessel is welded with a separator 3 of thick molybdenum plate to combine. The thick plate separator 3 may be of other material so far as heatproof metal such as tungsten. The thickness of the separator 3 is about 2 mm. A slit 4 is a long orifice to squeeze the discharge path to form a constriction. A slit 4 opens in the center of the separator 3. The oblong slit 4 is 1 mm in width and 300 mm in length.

Silica tubes 5 and 6 are thin silica tubes and form one part of the discharge vessel 1. They are prolonged toward the inside from the bottom of the discharge vessel 1. The inner side of the discharge vessel 1 and the outside of two thin silica tubes 5 and 6 are forming an airtight vessel (discharge space). One thin silica tube 5 is arranged so that it may be completely surrounded inside the shield box 2. The inner side of the thin silica tubes 5 and 6 is the outside of the discharge space and electrodes 7 and 8 are inserted there. Electrodes 7 and 8 are close inside the thin silica tubes 5 and 6. A metal twist line is inserted in the thin silica tubes 5 and 6 to be electrodes 7 and 8. Conductive filler is filled up among the inside surface of thin silica tubes 5 and 6 and electrodes 7 and 8. Deuterium gas in several kPa is filled in the discharge vessel 1. The function and the operation of the UV continuous spectrum lamp in the first embodiment of this invention as constituted above are explained. High-voltage sine wave in several kHz is applied between the electrodes 7 and 8. Consequently, dielectric barrier discharge arises in the deuterium gas between the electrodes 7 and 8. The electrode 7 is inside of the shield box 2 and the electrode 8 is outside of the shield box 2. As the shield box 2 is sealed up except slit 4, the discharge arises inevitably through the slit 4. According to the characteristics of dielectric barrier discharge, the discharge is not localized in one point on the electrode surface. The discharge arises on the whole surface of the electrode. Therefore, even though a long electrode, the discharge does not localize within one part and almost uniform discharge arises all over the electrode.

Therefore, the discharge is uniformly squeezed all along the slit 4. The current density becomes high in the discharge constriction at the slit 4. The continuous spectrum UV light is emitted. Consequently, strong UV light of dielectric barrier discharge in deuterium gas can be obtained in wide and long range on the slit 4 along the lamp axis. The UV light here mean the light in the wavelength range from about 10 nm to about 400 nm including vacuum UV range (wavelength range from about 10 nm to about 200 nm). High-voltage AC square wave instead of high-voltage sine wave may be applied between the electrodes 7 and 8.

The discharge gas may be not only deuterium gas but also hydrogen gas. It may be mixture rare gas with deuterium or hydrogen gas. In order to prolong the lifetime of the lamp, inner wall of the discharge vessel 1 opposite side to the slit 4 around the electrode 8 may be surrounded with thin plate such as nickel plate unless the discharge path is intercepted. In this way, the recombination of the hydrogen atoms and hydrogen ions are activated on the inner surface of the thin plate to return to hydrogen molecules and thereby the loss of hydrogen gas in the discharge vessel can be decreased.

As the lamp in the first embodiment of this invention is constituted as above, the illuminant intensity of continuous spectrum UV light can be increased high in wide area.

Embodiment 2

The second embodiment of this invention is a UV continuous spectrum lamp to irradiate continuous spectrum UV light by dielectric barrier discharge. Two electrodes are each covered with dielectrics to be separated from the discharge space. Two slits are formed so that the discharge path goes through one slit after another to be squeezed. Deuterium gas is filled in the discharge vessel.

Figure 2:
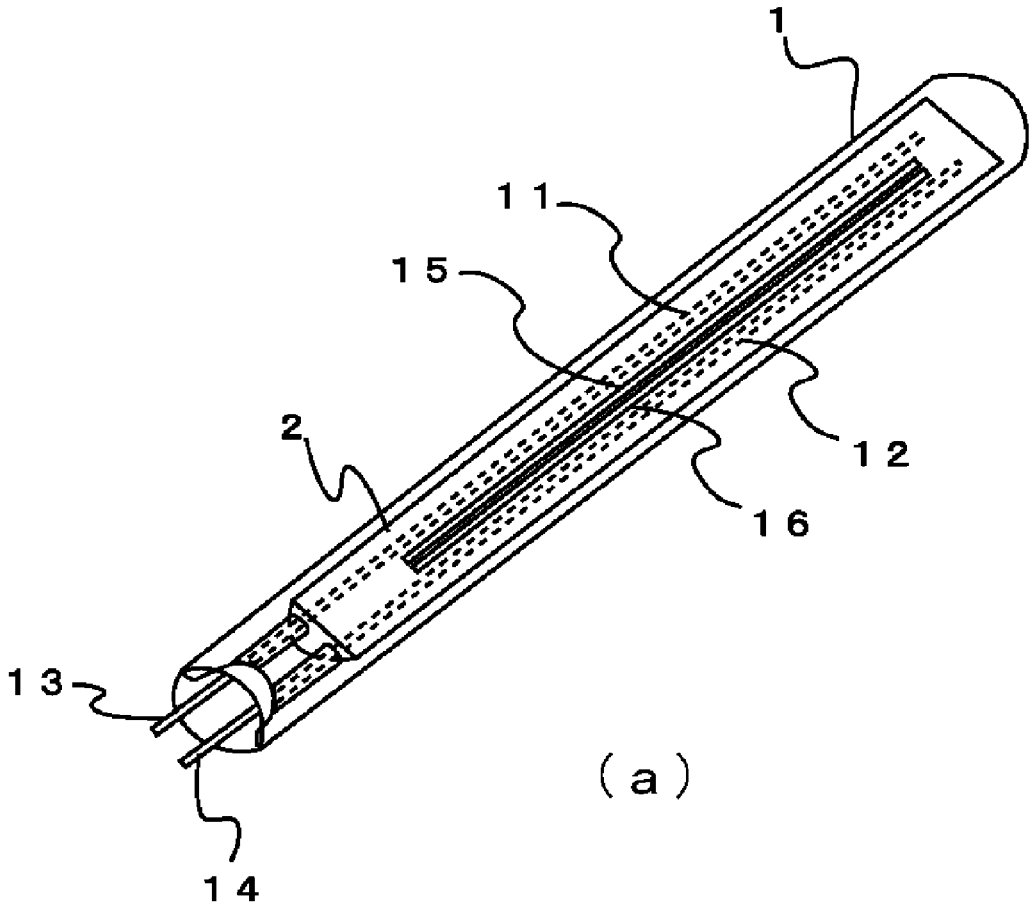
FIG. 2 It shows conceptual drawings of UV continuous spectrum lamp in the second embodiment of this invention.
Figure 2:
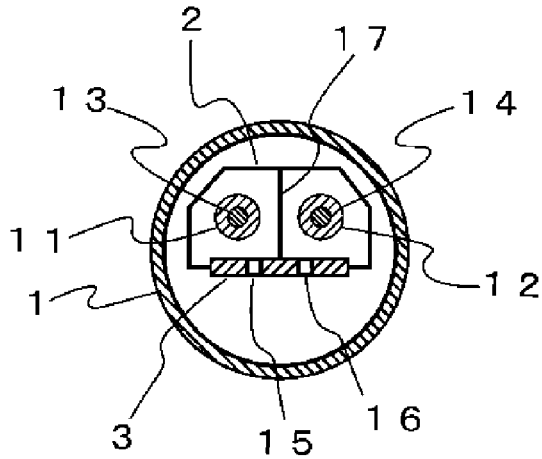

FIG. 2(*a*) is a whole perspective view of UV continuous spectrum lamp in the second embodiment of this invention. FIG. 2(*b*) is a drawing of a section perpendicular to the lamp axis. In FIG. 2, slits 15 and 16 are means to squeeze the discharge paths to form constrictions. Silica tubes 11 and 12 are thin silica tubes. Same as the first embodiment, thin silica tubes 11 and 12 are prolonged toward the inside from the bottom of the discharge vessel 1. Electrodes 13 and 14 are furnished inside the tubes. The shield box 2 is a means to separate the electrodes. The inside of it is separated by the partition 17. A pair of thin silica tube 11 and the electrode 13 is contained in one room of the shield box 2. Another pair of thin silica tube 12 and the electrode 14 is contained in another room of the shield box 2. Slits 15 and 16 are formed in each room on the separator 3 of a part of the shield box 2. They are arranged toward the outside of the shield box 2. That is, two slits are formed in parallel so that the discharge path is to pass one after another slit. The other components with the same reference number are the same as in the first embodiment.

The function and the operation of the UV continuous spectrum lamp in the second embodiment of this invention as constituted above are explained. The discharge path comes out of one electrode and goes out of the room once passing through the slit. And it passes through the other slit to reach another electrode. Same as in the first embodiment, the dielectric barrier discharge arises all over the electrode and continuous spectrum UV light radiates from whole slit. As the discharge path goes twice through the slits at high current density, higher irradiance can be obtained compared to the case of single slit.

The discharge gas may be not only deuterium gas but also hydrogen gas. It may be mixture rare gas with deuterium gas or hydrogen gas. And the slit may be divided at several points into plural slits to be arrayed inline. In this way, thermal deformation of slits at the constriction of discharge path can be avoided.

As the lamp in the second embodiment of this invention is constituted as above, the illuminant intensity of continuous spectrum UV light can be increased high in wide area.

Embodiment 3

The third embodiment of this invention is a UV continuous spectrum lamp. A shield box isolates one of two electrodes with two-cornered section. A separator with a slit is prepared between electrode pair. Deuterium gas is filled in a discharge vessel. Pulse voltage is applied to electrode pair so that pulse discharge is caused to reach abnormal glow discharge state and is terminated before shifting to arc discharge.

Figure 3:
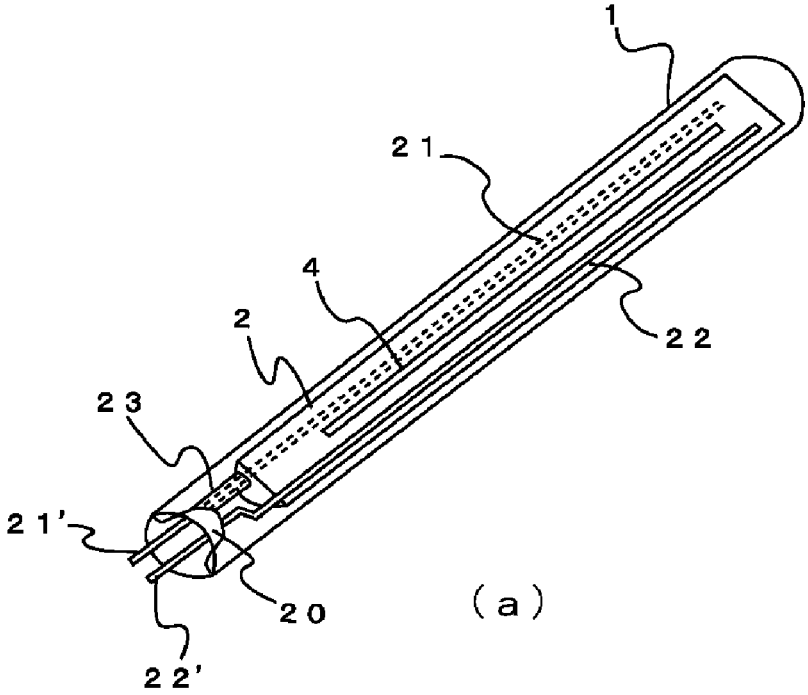
FIG. 3 It shows conceptual drawings of UV continuous spectrum lamp in the third embodiment of this invention.
Figure 3:
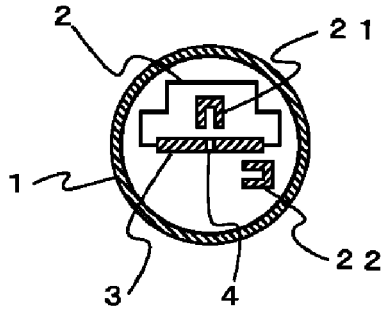
Figure 3:
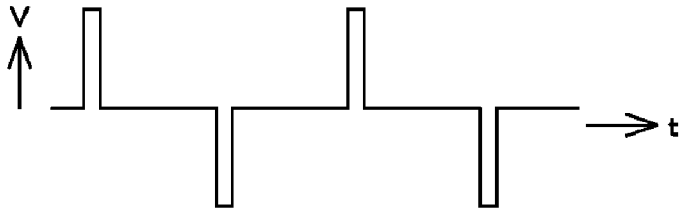

FIG. 3(*a*) is a perspective view of whole UV continuous spectrum lamp in the third embodiment of this invention. FIG. 3(*b*) is a diagram of the section perpendicular to the axis. FIG. 3(*c*) is voltage waveform to be applied at lighting. In FIG. 3, the electrodes 21 and 22 are concave metal wires with two-cornered section. The current lead wires 21' and 22' are sealed at the stem 20 of the discharge vessel 1 to be connected electrically with inside of the discharge vessel 1. Both of the electrode 21 in the shield box 2 and the external electrode 22 are connected to the current lead wires 21 and 22 at the stem. In addition, in this case, the electrode 21 is covered with the enclosure 23 similar to the shield box 2 to prevent discharge from occurring on the way from stem 20 to the shield box 2. The other components with the same reference number are the same as in the first and second embodiments.

The function and the operation of the UV continuous spectrum lamp in the third embodiment of this invention as constituted as above are explained. The voltage with the waveform as shown in FIG. 3(*c*) is applied to the electrodes 21 and 22 to perform AC pulse lighting. Discharge begins at the rising edge of pulse. At first, dark discharge begins then glow discharge arises. In glow discharge, cathode fall voltage and the current density in front of cathode are constant and the current increases. Since the section of the electrode is two-cornered, the hollow cathode effect arises. It causes glow discharge inside of the two-cornered electrode. Discharge current increases by progress of glow discharge and the discharging area on the cathode surface increases. At last, discharge becomes to occur at the whole inside of the two-cornered electrode. Then, it turns to abnormal glow discharge state. Cathode fall voltage drops and current density increase. It might turn to arc discharge if the current increases. But, voltage and width of pulse are set up so as to terminate the discharge before turning into arc discharge after covering of discharge over whole electrode.

The pulse width as set up appropriately as above can generate the discharge spread over whole electrode stably for every pulse. As a result, the spread discharge path is formed in the whole slit 4 of separator 3. Discharge path is squeezed by slit 4 to form constriction and the current density becomes high. Continuous spectrum UV light is emitted strongly from the wide area over the whole slit 4. In addition, although the electrode section is two-cornered, it is not necessarily limited to this shape. It may be in any shape such as planar or V-shaped so far as to function similarly. The power supply of the lighting device is necessary to generate such pulses to cause the abnormal glow discharge cover whole electrode surface and to terminate discharge before turning to arc discharge.

The discharge gas may be not only deuterium gas but also hydrogen gas. It may be mixture rare gas with deuterium gas or hydrogen gas. In order to prolong the lifetime of the lamp, an edge of the shield box 2 may be extended toward outside to cover the electrode 22 at outside of the shield box 2 unless the discharge path is intercepted. In this way, recombination of hydrogen atoms and hydrogen ions are activated to return to hydrogen molecules on the thin plate inner surface. Thereby, the loss of hydrogen gas in the discharge vessel can be decreased. And the slit may be divided at several points into plural slits to be arrayed inline. In this way, thermal deformation of slits at the constriction of discharge path can be avoided.

As the lamp in the third embodiment of this invention is constituted as above, the illuminant intensity of continuous spectrum UV light can be increased high in wide area. The lamp may be lit with pulse width fixed. Or the lighting device may be structured as that the voltage (current) should be cut while monitoring the lamp current to terminate the discharge at the detection of the specific current in the abnormal glow discharge before turning into arc discharge.

Embodiment 4

The fourth embodiment of this invention is a UV continuous spectrum lamp. One electrode is covered with dielectrics to be isolated from discharge space. The other electrode is a filament coated with thermionic emission material. A separator with slits is furnished between the electrodes. Deuterium gas is enclosed in the discharge vessel.

Figure 4:
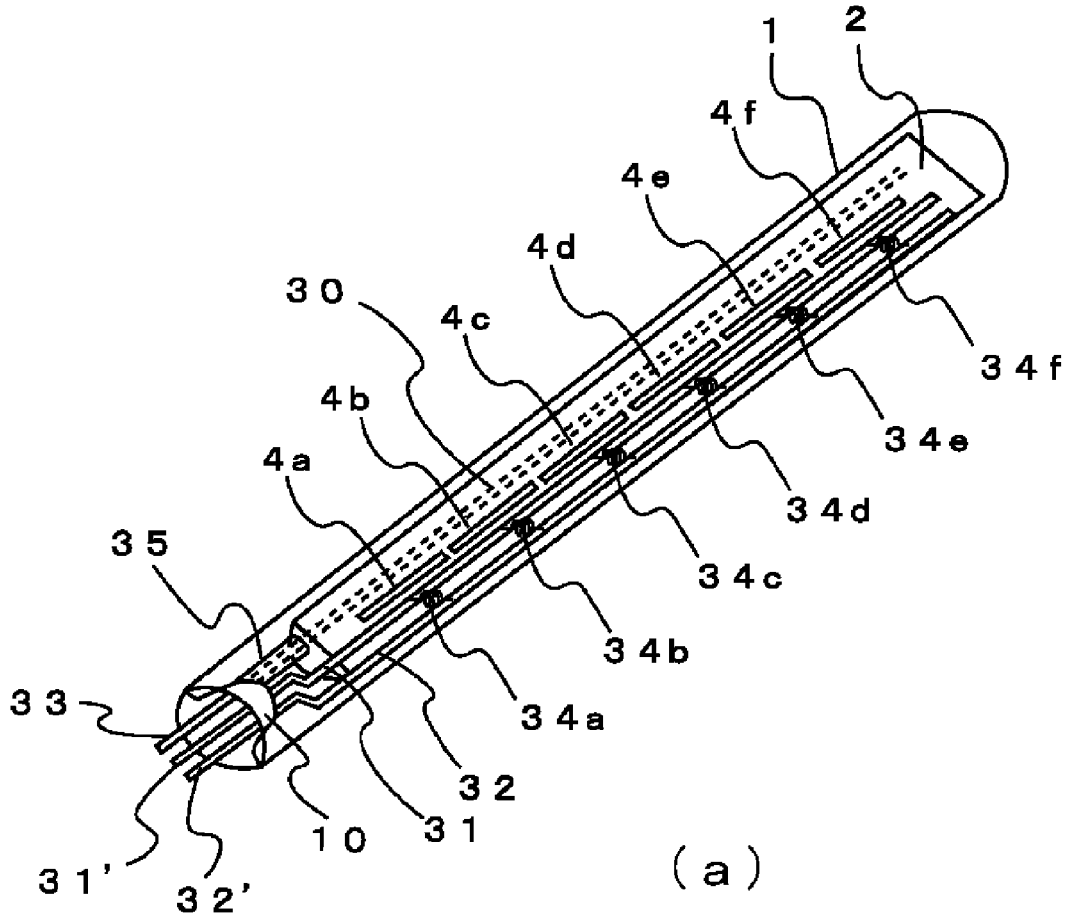
FIG. 4 It shows conceptual drawings of UV continuous spectrum lamp in the fourth embodiment of this invention.
Figure 4:
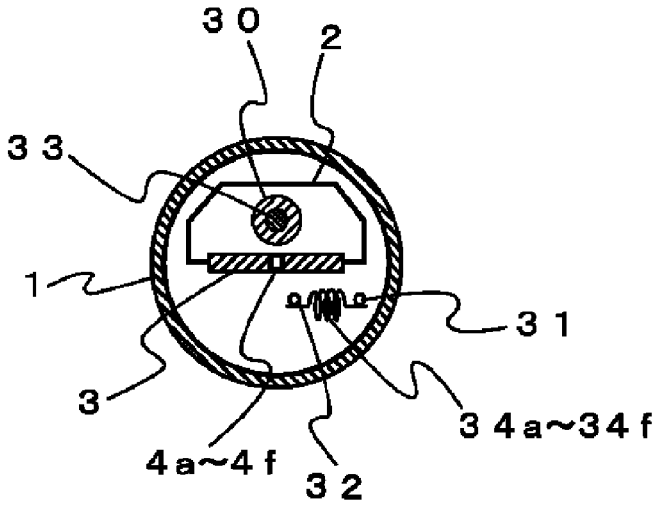

FIG. 4(*a*) is a perspective view of whole UV continuous spectrum lamp in the fourth embodiment of this invention. FIG. 4(*b*) is a diagram of the section perpendicular to the lamp axis. In FIG. 4, the thermionic emission electrodes 34*a*-34*f* are filaments (thin tungsten wire wound as a coil) with two lead wires connected at both ends. The electrodes are coated with thermionic emission material. The thin silica tube 30 is extended from the bottom to inside of the synthetic silica discharge vessel 1. The electrode 33 is furnished in the thin silica tube 30. The thin silica tube 30 and the electrode 33 are laid in the shield box 2. The stem 10 and the shield box 2 are insulated by the enclosure 35 in order not to cause discharge between them.

The electrode 33 in the shield box 2 is as long as the whole illuminant part. It is covered with dielectrics (thin silica tube 30). Then it operates as an electrode of dielectric barrier discharge. On the other hand, the nickel lead line wires 31 and 32 are arranged in parallel outside of the shield box 2. The lead wires 31 and 32 are connected to the current lead wires 31' and 32' at the stem 10. The lead wires 31 and 32 are connected to plural thermionic emission electrodes 34*a*-34*f*. Each of slits 4*a*-4*f* is formed according to each thermionic emission electrode to squeeze the discharge path. The other components with the same reference number are the same as in the first and second embodiments.

The function and the operation of the UV continuous spectrum lamp in the fourth embodiment of this invention as constituted as above are explained. Electric power in several volts is applied to two lead wires 31 and 32 to heat the thermionic emission material up to adequate temperature. Sine wave or square wave in high voltage for discharge is applied between the electrode 33 and either of lead wire of thermal cathode. The discharge arises between the thermionic emission electrodes 34*a*-34*f* and the other common electrode 33. The fan-shaped discharge path is formed from small regions on the thermionic emission electrodes 34*a*-34*f* to the other electrode as the current is concentrated to comparatively small regions of each electrode. The voltage necessary to discharge can be decreased and the power consumption can also be decreased as thermionic emission electrode is used for one part of electrode. Consequently, simple power supply can be used and the efficiency of lamp becomes well.

The discharge gas may be not only deuterium gas but also hydrogen gas. It may be mixture rare gas with deuterium gas or hydrogen gas. In order to prolong the lifetime of the lamp, an edge of the shield box 2 may be extended toward outside to cover the electrodes 34*a*-34*f* at outside of the shield box 2 unless the discharge path is intercepted. In this way, recombination of hydrogen atoms and hydrogen ions are activated to return to hydrogen molecules on the inner surface. Thereby, the loss of hydrogen gas in the discharge vessel can be decreased.

As the lamp in the fourth embodiment of this invention is constituted as above, the illuminant intensity of continuous spectrum UV light can be increased high in wide area.

Embodiment 5

The fifth embodiment of this invention is a UV continuous spectrum lamp. A separator with slits is furnished between the electrodes. Deuterium gas is enclosed in the discharge vessel. High-frequency voltage from 500 kHz to 100 MHz in frequency is applied to electrode pair.

The basic structure of the UV continuous spectrum lamp in the fifth embodiment of this invention is the same as the first, second and third embodiments. But it is different in that the discharge is performed with high-frequency current more than 500 kHz. In case of high-frequency discharge, ceramics of high melting point is used for the material to form the shield box 2 and slit 4. The example of ceramics of high melting point is alumina or boron nitride etc. The high-frequency voltage of 13.56 MHz, for example, is applied between the electrodes. As a result, there arises a high-frequency discharge between the electrodes. At this time, the discharge between the electrodes depends upon the intensity of the high-frequency electric field according to the high-frequency voltage applied to the electrodes. In this case, as the electrodes are arranged in parallel, the electric field is constant regardless of position. Therefore, high-frequency discharge arises uniformly in the direction of the axis similarly to the positive column of glow discharge. As the discharge path is squeezed by the slit 4, plasma of high current density is formed at this constriction. Consequently, strong continuous spectrum UV light can be obtained in the large irradiation area same as in the first, second and third embodiment. As the lamp in the fifth embodiment of this invention is constituted as above, the illuminant intensity of continuous spectrum UV light can be increased high in wide area.

INDUSTRIAL APPLICABILITY

The UV continuous spectrum lamp of this invention is the optimal as an industrial lamp to irradiate continuous spectrum UV light with high illumination.

REFERENCE SYMBOLS

1 Synthesized silica discharge vessel
2 Shield box
3 Heat-proof separator (a part of shield box)
4, 15, 16, 4*a*-4*f* Slit
5, 6, 11, 12, 30 Thin silica tube (a part of discharge vessel)
7, 8, 13, 14, 33 Electrode
10, 20 Stem
17 Partition
21, 22 Electrode with two-cornered section
23, 35 Enclosure
21', 22', 31', 32' Current lead wire
31, 32 Lead wire
34*a*-34*f* Thermionic emission electrode

The invention claimed is:

1. A UV continuous spectrum lamp comprising:

a UV transparent discharge vessel with an enclosed discharge gas, a pair of electrodes disposed in said vessel, said electrodes being supplied with voltage in order to discharge, and at least one of said pair of electrodes being elongated along an axis of said discharge vessel, a separator provided between said electrodes, and a slit formed in said separator to squeeze discharge path between said electrodes, wherein said slit is elongated in the direction of a longer axis of said discharge vessel, and wherein said discharge gas in said discharge vessel is deuterium gas, hydrogen gas, a mixture gas with deuterium or a mixture gas with hydrogen.

2. A UV continuous spectrum lamp comprising a UV transparent tubular discharge vessel, an electrode pair to apply voltage to in order to discharge, and a separator with slits to squeeze discharge path between said electrodes, wherein deuterium gas, hydrogen gas, mixture gas with deuterium or mixture gas with hydrogen is enclosed as discharge gas in said discharge vessel, and wherein plural of said slits are disposed in series in the direction of the longer edge of said slits or disposed in parallel in the direction perpendicular to the longer edge of said slits or disposed as a lattice in both directions along the longer edge of said slits and perpendicular to it.

3. A UV continuous spectrum lamp as described in either of claims 1 or 2, wherein at least one electrode in said electrode pair is covered with dielectric to be isolated from discharge space.

4. A UV continuous spectrum lamp as described in either of claims 1 or 2, wherein one electrode in said electrode pair is covered with dielectric to be isolated from discharge space and the other electrode in said electrode pair is an electrode of filament in discharge space coated with thermionic emission material.

5. A lighting device to light a UV continuous spectrum lamp as described in either of claims 1 or 2 in whose electrode pair at least one electrode is in discharge space, comprising a means to generate pulse voltage to apply to said electrode pair so as to cause discharge to reach abnormal glow discharge and to terminate discharge before turning to arc discharge.

6. A lighting device to light a UV continuous spectrum lamp as described in either of claims 1 or 2, comprising a means to generate lighting voltage from 1 kHz to 500 kHz in frequency to apply to said electrode pair.

7. A lighting device to light a UV continuous spectrum lamp as described in either of claims 1 or 2, comprising a means to generate lighting voltage from 500 kHz to 100 MHz in frequency to apply to said electrode pair for high frequency discharge.

* * * * *